United States Patent [19]

Bell

[11] 4,202,053

[45] May 13, 1980

[54] WEATHER-PROOF GARMENT

[76] Inventor: Michael Bell, P.O. Box 400, Warrington, Pa. 18976

[21] Appl. No.: 960,886

[22] Filed: Nov. 15, 1978

[51] Int. Cl.[2] ..... A41D 3/08

[52] U.S. Cl. ..... 2/84; 2/87; 2/DIG. 6

[58] Field of Search ..... 2/84, 87, 88, 89, 82, 2/93, 94, DIG. 6

[56] References Cited

U.S. PATENT DOCUMENTS

| | | | |
|---|---|---|---|
| 913,694 | 3/1909 | Carpenter | 2/88 |
| 2,932,034 | 4/1960 | Carroll | 2/88 |

FOREIGN PATENT DOCUMENTS

| | | | |
|---|---|---|---|
| 1057246 | 10/1953 | France | 2/84 |
| 861362 | 2/1961 | United Kingdom | 2/88 |

OTHER PUBLICATIONS

VELCRO Product News; Sept. 1978, PN No. 49, Rec'd in Mail Room Sept. 11, 1978.

*Primary Examiner*—H. Hampton Hunter

*Attorney, Agent, or Firm*—Caesar, Rivise, Bernstein & Cohen, Ltd.

[57] ABSTRACT

A water-repellent garment for particular use by meter readers. The garment is of a flexible material having a front panel including an opening in which is releasably secured a rigid, fog-proof, transparent window, to enable the reader to see through the window to read or write on cards held under the garment. The window is secured within the opening through the use of releasably securable means, such as VELCRO fastening tape. The releasable securement feature permits removal or replacement of the window, if desired, while also forming a weather-tight seal between the window and the garment material.

7 Claims, 4 Drawing Figures

WEATHER-PROOF GARMENT

This invention relates generally to garments, and more particularly, ponchos, capes, jackets, etc., adapted to be worn by meter reading personnel.

Meter reading personnel frequently are called upon to perform their meter reading duties in all types of inclement weather, e.g., rain, sleet, etc. In order to protect the reader, capes, ponchos, etc., are frequently worn. The information read from the meter is normally recorded by the reader on computer or other type of machine-readable cards. The exposure of such cards to the inclement weather frequently results in irreparable damage to the cards.

Accordingly, the need existed for a garment which could be worn by the meter reader to protect him or her from the weather while also enabling the reader to fill out the cards under the garment, thereby protecting the cards as well.

Recently, a nylon poncho designed for meter readers has been offered commercially. To that end, that poncho includes a transparent flexible plastic panel or window permanently secured in the front thereof to enable the reader to record meter readings on cards held under the poncho, with the cards being visible through the window.

While that garment appears, generally suitable for its intended purpose, the flexible plastic window is susceptible to abrasion or other surface damage, thereby impairing its transparency. Moreover, the storage of such ponchos, if accomplished by folding the garment, may cause the plastic to be rippled or creased, thereby distorting vision therethrough, while also further degrading the transparency of the plastic. The degradation of vision through the window can only be tolerated so long and when the garment must be discarded for a new one. Needless to say, this can represent a considerable expense.

Accordingly, it is a general object of the instant invention to provide a garment for use by meter readers or others and which overcomes the disadvantages of the prior art.

It is a further object of the instant invention to provide a garment having a rigid, transparent window, releasably secured in an opening in the front panel thereof.

It is a further object to the instant invention to provide a garment having a window releasably secured, in a good weather-tight seal, in an opening in the front panel of the garment.

These and other objects of this invention are achieved by providing a garment formed of a flexible, water-repellent material. The garment has a front panel including an opening. A rigid, transparent window pane is releasably secured in the opening in a good weather-tight seal by releasable securement means.

In a preferred embodiment of the invention the releasable securement means comprises a two-component fastening tape system, one of said components having a multitude of hook-like elements projecting therefrom and the other component having a plurality of loop-like elements projecting therefrom and which are engaged by the hook-like elements to secure the two components together. One component of the fastening type system is connected along the periphery of the window while another component is secured along the periphery of the opening.

Other objects and many of the attendant advantages of this invention will be readily appreciated as the same becomes better understood by reference to the following detailed description when considered in connection with the accompanying drawings wherein.

Figure 1:
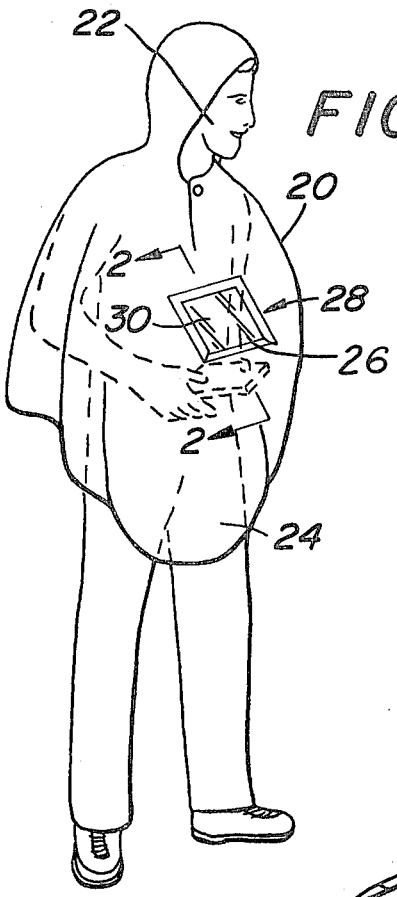
FIG. 1 is a front elevational view of a typical meter reader wearing the garment of the instant invention.
Figure 2:
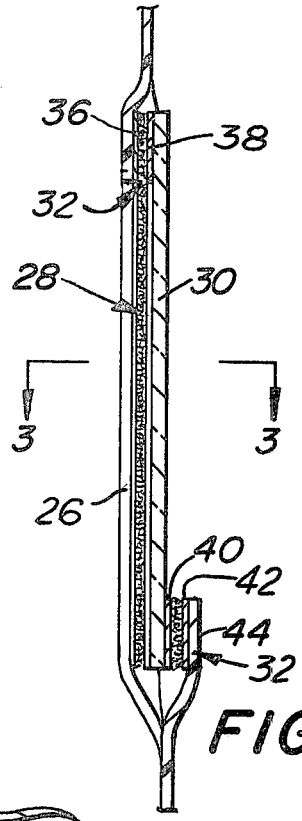
FIG. 2 is an enlarged sectional view taken along line 2—2 of FIG. 1.

Referring now to the various figures of the drawing wherein like reference characters refer to like parts, there is shown in FIG. 1 a garment 20 constructed in accordance with the instant invention and worn by a meter reader 22. The garment is arranged to enable the reader to hold and fill out materials, e.g., computer cards, upon which the meter readings are to be recorded under the garment, while permitting him to see the cards through a transparent portion of the garment.

As can be seen in FIG. 1 the garment 20 is of a generally poncho-like construction having a front panel 24 including a rectangular opening 26 therein. The opening 26 is located within the front panel in the portion which overlies the abdomen-chest area of the wearer 22. A transparent window assembly 28 is releasably secured within opening 26. The window assembly 28 comprises a rectangular window pane 30 and part of the means for securing the window in place, as will be described in detail later. The pane 30 is formed of a rigid, transparent material, e.g., plastic or glass, and is preferably fog-proof. While any conventional material can be used for the window pane 30, it is preferred that the material selected be resistant to abrasion and optically non-distorting. Such windows are commercially available from National Hydron.

The releasable securement of the window pane 30 in the opening 26 is accomplished by releasable securement means 32.

In accordance with a preferred aspect of this invention, the releasable securement means 32 comprises a fastening tape system, such as VELCRO tape, manufactured by Velcro Manufacturing Company of Manchester, N.H. As is known, VELCRO tape consists of two separable components or strips. One component strip has a back surface and a front surface having a large plurality of loop-like elements thereon and the other component strip has a front surface and a back surface having a large plurality of hook-like elements thereon. The strips are adapted to be secured to each other by the co-action of the hook-like elements and the loop-like elements. To that end the strips are abutted, such that the hook-like elements contact and intertwine the loop-like elements, to effect the securement between the two strips. The resulting securement between the strips is very firm, yet the strips can be readily detached by pulling one off the other.

Figure 4:
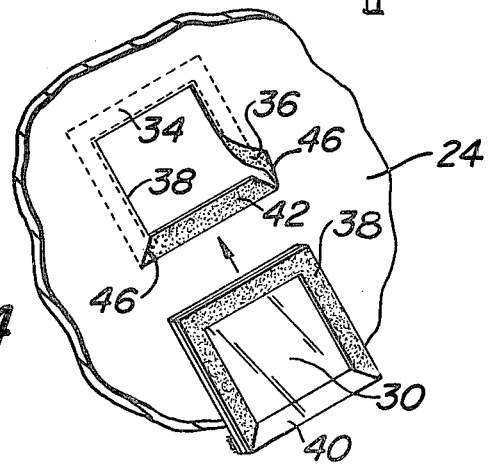
FIG. 4 is a perspective view of a portion of the garment shown in FIG. 1 and showing the insertion of the window therein.
Figure 3:
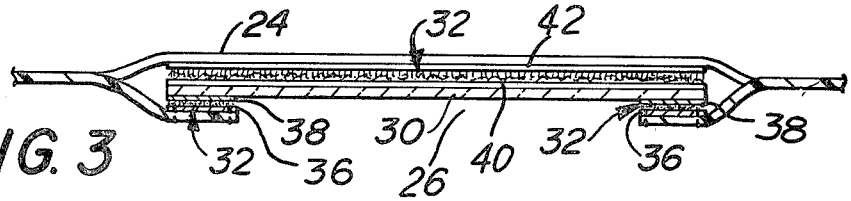
FIG. 3 is a sectional view taken along line 3—3 of FIG. 2.

As shown in FIGS. 1 and 4, the opening 26 is of rectangular shape and includes a pair of slits 46 in the front panel at opposed lower corners of the opening, each extending at a 45 degree angle to the bottom edge of the opening, to form a flap 42 therebetween. One component strip, i.e., the loop-bearing component, 36 is permanently secured, such as by sewing or by an adhesive, onto the underside surface of the panel 24 contiguous with the top and side edges of the opening 26. When the strip 36 is secured in place its rear surface abuts the inner surface of the front panel so that its engaging elements, or loops project inward. Another loop-bearing component strip 42 is similarly permanently secured on the outside surface of the flap 44 so that its engaging elements or loops, project outward.

A strip 38 of the other or coacting component of the releasable securement means 32, i.e., the hook-bearing component, is fixedly secured on the outside surface of the window pane 30 along the top and sides edges thereof. The strip 38 is secured to the window by the application of adhesive between the back surface of the strip 38 and the underlying periphery of the window. When secured thusly, the strip's hooks, project outward. A similar strip 40 is similarly secured on the inside surface of the window pane 30 along the bottom edge thereof so that its hooks project inward.

As will be appreciated by those skilled in the art, the slits 46 coact with the bottom edge of the opening to form a mouth through which the window can be inserted or removed in the opening 26.

When the window is oriented as shown in FIG. 4, and inserted in the direction of the arrow therein fully over the opening 26 and under the peripheral edges of the front panel forming the top and sides of the opening, the multitude of hook-like elements on strip 38 engage the multitude of loop-like elements on strip 36, while the multitude of hook-like elements on strip 40 engage the multitude of loop-like elements on strip 42. This action releasably secures the window pane 30 in opening 26 and under the front panel portion contiguous with the opening along its top and sides.

The securement of the window pane under the front panel portions contiguous with the top and sides of the opening 26 is of considerable importance since any water which may impinge on the garment 20 during use rolls down the front panel across the outer surface of the front panel portion contiguous with the window, across the window and back onto the front panel below the window. Thus, water does not gain ingress between the engaged strips 36 and 38 and engaged strips 40 and 42.

If it is desired to remove the window, e.g., if the window becomes scratched or otherwise impaired or even if one desires to store the garment 20 without the window therein, all that is required is to grasp the lower edge of the window pane 30 which overlies the flap 44 to lift up slightly thereon to thereby separate the tape portions 40 and 42. The strips portions 36 and 38 are then pulled apart, thus freeing the window and enabling it to be removed from the opening 26 for repair, replacement, or storage.

While the garment shown at 20 in FIG. 1 is shown as a poncho, i.e., including a hood, it is clear the garment 20 can be configured in various ways, e.g., a cape etc., so long as it includes a front panel with a rigid, transparent window releasably secured therein.

In accordance with a preferred embodiment of the garment 20 is formed of a weather-proof nylon.

It must be pointed out at this juncture that while the opening 26 and the window 30 are shown as being of rectangular cross section, it is clear that the opening in the window can be of any desired shape, e.g., circular, oval, etc. In such alternative constructions, it is still desirable that one portion of one component of the fastening tape be secured on the underside of the front panel continguous with the upper and lateral peripheral portions of the opening 26, and with the remaining portion of that component secured on the outer lower peripheral portion of the opening, while one portion of the engaging component of the fastening tape is secured to the outside surface of the window along the upper and lateral peripheral portions and the remaining portion of the engaging component is secured to the underside of the window along the lower periphery thereof. Such a construction insures that any water which may trickle down the garment will not gain ingress through the interface of the co-acting tape strips.

It must also be pointed out at this juncture that while the hook bearing components of the VELCRO strip are shown connected to the window pane while the components are secure to the garment, either type of component can be secured to the material of the front panel so long as the co-acting type of component is connected to the window pane.

Moreover, releasable fastening means other than VELCRO strips can be used to effect the releasable securement of the window in the opening.

It should thus be appreciated from the foregoing that the garment of the instant invention provides a viable means for enabling meter readers to accomplish their tasks in all types of inclement weather and without risk of damage to their cards. The use of a releasably securable rigid window extends the life of the garment by enabling replacement of the window in the event that it becomes damaged or otherwise unusable. Moreover, by enabling the window to be removed readily, storage of the garment, by tightly folding the same, can be accomplished easily and without risk to damage to the window.

Without further elaboration, the foregoing will so fully illustrate my invention that others may, by applying current or future knowledge, readily adapt the same for use under various conditions of service.

What is claimed as the invention is:

1. A garment for disposition on the trunk of a wearer and formed of a flexible, water-repellent material said garment having a front panel including an opening therein, a relatively rigid, transparent window pane and releasable securement means, said front panel including an inner surface, the periphery of said opening being defined by upper, lateral and lower edge portions, said window pane including an inner and outer surface, the periphery of said window pane being defined by upper, lateral and lower edge portions, said releasable securement means releasably securing the outer surface of said window pane along its upper and lateral edge portions to the inner surface of said front panel along the upper and lateral edge portions of said opening with said upper and lateral edge portions of said panel overlapping said upper and lateral edge portions of said window pane and with said lower edge portion of said window pane overlapping said lower edge portion of said panel to completely cover said opening in a good weather-tight relationship.

2. The garment of claim 1 wherein said releasable securement means comprises two coacting component members, one of said component members being fixedly secured to the inner surface of said front panel along the upper and lateral edge portions of said opening and the other of said component members being fixedly secured to the outer surface of said window pane along the upper and lateral edge portions thereof, said component members coacting to secure the upper and lateral edge portions of the periphery of the opening in said front panel to said upper and lateral edge portions of the periphery of said window pane.

3. The garment of claim 2 wherein said releasable securement means comprises fastening tape means in which one of said component members has a large plurality of loop-like elements thereon and the other component member has a large plurality of hook-like elements thereon.

4. The garment of claim 3 wherein said window panel is formed of a fog-proof material.

5. The garment of claim 4 wherein said garment comprises a poncho arranged to be worn so that the window pane is disposed adjacent to the chest-abdomen area of the wearer.

6. A poncho formed of a flexible, water-repellent material and having a front panel including an opening therein, a relatively rigid, transparent window pane formed of a fog-proof material and releasable securement means for releasably securing said window pane in said opening in a good weather-type relationship so that when worn, the window pane is disposed adjacent to the chest-abdomen area of the wearer, said releasable securement means securing the periphery of the opening in the front panel to the window pane and comprising fastening tape means having a pair of component members, one of said component members having a large plurality of loop-like elements thereon and the other component member having a large plurality of hook-like elements thereon, said front panel including an inner and outer surface, said window having an inner and outer surface and wherein one of said component members of said fastening tape is secured to the inner surface of said front panel along a portion of the periphery of said opening and to the outer surface of said front panel contiguous with a portion of the periphery of said opening, with the other said component members of said fastening tape being secured to the outer surface of said window pane about a portion of the periphery thereof and to the inner surface of said window pane along a portion of the periphery thereof.

7. The garment of claim 6 wherein the fastening tape component member which is secured to the inner surface of the front panel contiguous with the opening extends about the entire periphery thereof except for the lower porion of the periphery and wherein the fastening tape component member which is secured to the outer surface of said panel contiguous with the opening extends for only the lower portion of said periphery, and wherein the fastening tape component member secured to the outer surface of said window extends along the periphery thereof for all portions except the lower portion of the periphery and wherein the fastening tape component member secured to the inside surface of said window pane extends only along the lowermost portion of the periphery thereof.

* * * * *